US010160914B2

(12) United States Patent
Comfort, III et al.

(10) Patent No.: US 10,160,914 B2
(45) Date of Patent: Dec. 25, 2018

(54) PROCESS AND SYSTEM FOR ABOVE GROUND EXTRACTION OF CRUDE OIL

(71) Applicant: TRC OPERATING COMPANY, INC., Taft, CA (US)

(72) Inventors: Charles H. Comfort, III, Taft, CA (US); Tracy D. Rogers, Taft, CA (US); Ronnie D. Rogers, Taft, CA (US); Aaron T. Rhoten, Taft, CA (US); Michael P. Doyle, Taft, CA (US); Stanley W. Ellis, Taft, CA (US); Glenn Richards, Taft, CA (US)

(73) Assignee: TRC OPERATING COMPANY, INC., Taft, CA (US)

( * ) Notice: Subject to any disclaimer, the term of this patent is extended or adjusted under 35 U.S.C. 154(b) by 0 days.

(21) Appl. No.: 15/915,575

(22) Filed: Mar. 8, 2018

(65) Prior Publication Data

US 2018/0273847 A1 Sep. 27, 2018

Related U.S. Application Data

(60) Provisional application No. 62/471,229, filed on Mar. 14, 2017, provisional application No. 62/555,547, filed on Sep. 7, 2017.

(51) Int. Cl.
*C10G 1/04* (2006.01)

(52) U.S. Cl.
CPC ..... *C10G 1/045* (2013.01); *C10G 1/047* (2013.01); *C10G 2300/44* (2013.01); *C10G 2300/805* (2013.01)

(58) Field of Classification Search
CPC ..... C10G 1/04; C10G 1/045
See application file for complete search history.

(56) References Cited

U.S. PATENT DOCUMENTS

| | | | | |
|---|---|---|---|---|
| 4,240,897 | A * | 12/1980 | Clarke | C10C 3/007 208/425 |
| 4,719,008 | A * | 1/1988 | Sparks | C10G 1/04 208/390 |
| 9,926,494 | B1 | 3/2018 | Whitzell et al. | |
| 2007/0131590 | A1* | 6/2007 | Bozak | C10G 1/045 208/390 |
| 2012/0187028 | A1* | 7/2012 | Mickler | B09B 3/00 208/429 |

* cited by examiner

*Primary Examiner* — Randy Boyer
(74) *Attorney, Agent, or Firm* — Karish & Bjorgum, PC

(57) ABSTRACT

Processes and systems for the above ground extraction of crude oil from a mud-water slurry well bore mined from oil rich diatomite formations. The slurry is separated into liquid and solid factions, the liquid faction having oil, water and small sized solids, and the solid faction having larger chunks of solids. The solids faction is processed to form a slurry mixture which is cooked to disassociate oil therefrom and is centrifuged to yield an oil/solvent faction, a water faction, and a lowered oil content solids faction. The oil/solvent faction is further processed to separate the oil and solvent. Alternately, the mud-water slurry is treated to form an emulsion having a neutral pH, with solids being removed and the remaining emulsion processed to break the emulsion by removal of water as a vapor to recovery crude oil, with remaining crude oil in the solids being further processed.

9 Claims, 5 Drawing Sheets

PROCESS AND SYSTEM FOR ABOVE GROUND EXTRACTION OF CRUDE OIL

CROSS REFERENCE TO RELATED APPLICATIONS

This application claims priority to prior filed provisional patent application No. 62/471,229, filed on Mar. 14, 2017, entitled "STABLE CRUDE OIL EMULSIONS AND METHODS TO MANUFACTURE" and prior filed provisional patent application No. 62/555,547, filed on Sep. 7, 2017, entitled "PROCESS AND SYSTEM FOR ABOVE GROUND EXTRACTION OF CRUDE OIL FROM OIL-BEARING MATERIALS."

FIELD OF THE INVENTION

The invention relates to processes and systems for the above ground extraction of crude oil from oil-bearing material, such as diatomite formations, and particularly to an above ground process and system where the oil-bearing material is brought to the surface and the crude oil extraction occurs above ground, rather than in situ, and without introducing any harmful chemicals into the earth when removing the oil-bearing material from the formation and without leaving any remaining harmful chemicals into the formerly oil-bearing material, thus allowing such oil stripped and harmful chemical free material to be reintroduced to the formation.

BACKGROUND OF THE INVENTION

It is known that many hydrocarbon reserves currently available are represented by oil sands, oil rocks, oil shales, and diatomaceous formations containing the so-called non-conventional oils, i.e. extra heavy oils or tars. Non-conventional oils have an extremely high density (lower than 10° API) and a very high viscosity (higher than 10,000 cps) and, consequently, do not flow spontaneously under the reservoir conditions. Their exploitation is therefore linked to intrinsically high costs for the mining and production set-up of the reservoirs which must be assisted by the application of costly technologies. Mining and production set-up technologies of these reservoirs and for the extraction of said non-conventional oils are known in the art.

The prior art has many examples of using solvents to extract crude oil from diatomite. A large number of these processes attempt to treat the diatomite rock in situ or in place. However, since these methods have first come into practice, there have been new discoveries about the impact of injecting solvents underground what can have a serious effect on water supplies, particularly those closer to the surface. It is no longer considered environmentally safe to inject solvents like turpentine and naphtha underground under pressure to recover oil let alone using heat and steam to make the solvent hot underground. Too much of the solvent is left in the ground and can potentially enter the water supply. Thus, all prior art using this method is no longer a viable option for oil extraction from diatomite.

Other prior art methods took diatomite material that had hydrocarbon trapped within it, and made pellets or solids on the surface and then extracted the hydrocarbon using devices including centrifugal extractors. Although effective at oil removal, it was very expensive to mold tons of diatomite ore into pellets. To make the pellets mechanically stable required substantial pressure. The higher in pressure the diatomite was exposed to the lower the pore sizes and the lower the recovery rate of oil. In addition to high capital costs, typical systems using this approach had to deal with oil recoveries ranging from 70% to 85% of the total amount of oil present in the diatomite. Substantial solvent material was left in the pellets, which makes them hazardous to handle. Replacing the pellets underground left water supplies once again exposed to possible solvent contamination and a risk of long term leaching of solvent and oil into the ground and surrounding aquifers.

Another prior art method heated the diatomite formations or injected high pressure steam to raise the temperature sufficiently to get flow of oil in situ and then attempt recovery underground, separating oil and condensed water at the surface. This method did not address the replacement of large volumes of materials removed from underground and was prone to issues of subsidence and long term leaching of low boiling point components coming from the diatomite. Attempts to reinject water to replace the lost oil volumes were unpredictable and in general may have led to long term subsidence in these zones.

Non-conventional oils can also be extracted, for example, by strip mining, a process which requires the use of excavation and transport machinery which allow mining on different quarry faces. In this case, the mining is carried out by the recession of a single step (or quarry face), or stripping by descending horizontal sections. Strip mining is also used for reservoirs situated at a few tens of meters of depth. The material obtained by strip mining is normally subjected to grinding in order to break the physicochemical bonds between its constituents and to limit the cohesion between them, and, at the same time, to increase the overall effective surface, meaning the surface of said material which will be subsequently exposed to the action of the extraction solvent. In this way, stony rock (e.g., quartz sandstone with slightly cemented bitumen) becomes loose rock, or "earth." This grinding is normally carried out at a temperature (generally lower than or equal to 150° C.) which does not cause aggregation phenomena of the bituminous substance present in said material, and allows particles (i.e., tailings) to be obtained, having the particle size of sand (<2 mm). Hot water is added to the particles thus obtained, together with optional chemical additives in order to form a slurry, which is subsequently fed to an oils extraction plant, where it is subjected to stirring. The combined action of hot water and stirring causes the adhesion of small air bubbles to the oils, forming a bitumen froth which rises to the surface and can be recovered. The remaining part can be further treated to remove the residual water and the oil sand. The oils thus extracted, which are heavier than conventional oils, can be subsequently mixed with lighter oil (liquid or gas), or they can be chemically separated and subsequently upgraded for producing synthetic crude oil.

The above process is in extremely widespread use and is diversified and is normally applied to the oil sands of Western Canada, where they emerge at surface level, or can be found at a few tens of meters of depth. in these contexts, the production of a barrel of oil requires the treatment of about two tons of oil sand, with a recovery yield of the oils from the formation equal to about 75%, said yield being calculated with respect to the total quantity of the oils present in said formation. The tailings, or particles already treated, which contain a hydrocarbon fraction which has not been removed, can be further treated until a recovery yield of said oils equal to about 90% has been reached. This process, however, cannot be used in the case of reservoirs situated at greater depths. In such cases, in situ technologies are generally applied, which are mainly aimed at reducing the oil viscosity in the reservoir, situated at a depth ranging from a few tens to thousands of meters, by the introduction of vapor, solvents and/or hot air. The extraction can be carried out, for example, by means of the cold flow process (Cold Heavy Oil Production with Sand—CHOPS) which allows the recovery of oils by pumping them directly from the sand reservoir. When the oils, even if extremely dense, are in any case able to flow, they are pumped using progressive cavity pumps.

The CHOPS process is commonly used in the reservoirs of Venezuela and Western Canada. While the CHOPS process has the advantage of being economical, a major disadvantage is a low recovery yield of oils that is equal to about 5%-6% with respect to the total quantity of the oils present in the reservoir. By removing the filters which prevent the fine particles from flowing from the reservoir towards the surface, the production of sand associated with the oils increases considerably causing the formation of winding ducts in the subsoil and allowing an increase in the oil recovery factor (recovery yield equal to about 10% with respect to the total quantity of the oils present in the reservoir).

Another known in situ process is Cyclic Steam Stimulation (CSS). The CSS process, also known as "huff-and-puff", is based on the cyclic introduction of high-temperature (300° C. to 400° C.) steam into the reservoir, for prolonged periods (from weeks to months), to allow the vapor to heat the mineralized formation and to fluidity the oils which can thus be recovered at the surface. The CSS process, widely used in Canada, can be repeated several times on the basis of technical and economic verifications. Although it allows a good recovery of the oils, with a recovery yield equal to about 20%-25% with respect to the total quantity of the oils present in the reservoir, the CSS process is disadvantageous from an economical point of view as it has high running costs.

Another known in situ process is Steam Assisted Gravity Drainage (SAGD). The development of directed drilling techniques has allowed the SAGD process to be developed, which is based on the drilling of two or more horizontal wells at a few meters of distance in vertical with respect to each other and with an extension of kilometers with different azimuths. Steam is introduced into the upper well. The heat lowers the crude's viscosity, allowing the oil which accumulates by gravity in the lower well, to be collected and pumped to the surface.

The SAGD process, which can also be applied to the mineral mining of shallow reservoirs, is more economical that the Cyclic Steam Stimulation (CSS) process and leads to a good oil recovery yield, with yield being equal to about 60% with respect to the total quantity of the oils present in the reservoir.

Another known in situ process is the Vapor Extraction Process (VAPEX). The VAPEX process is similar to the Steam Assisted Gravity Drainage (SAGD) process, but hydrocarbon solvents are introduced into the reservoirs instead of steam, obtaining a better extraction efficiency and favoring a partial upgrading of the oils already inside the reservoir. The solvents are costly, however, and have a considerable impact on both the environment and safety of the work site (e.g., risks of fires and/or explosions).

A further known in situ process is Oil Sand Underground Mining (OSUM). Most of the tar oil reservoirs of Western Canada and almost all of those in Venezuela are situated at such depths that the application of strip mining is not economical. This technique is sometimes also applied to reservoirs situated at depths lower than 50 m. The OSUM processes, however, can have various drawbacks. For example, the OSUM process requires the use of large quantities of water which is only partly recycled and must therefore be subjected to further treatments before being disposed of. In the case of Western Canada, for example, the volume of water necessary for producing a single barrel of synthetic crude oil—SCO, is equal to 2 to 4.5 times the volume of oil produced. Furthermore, these processes are generally characterized by a low extraction yield.

Attempts have been made in the art to overcome the above drawbacks. European patent application EP 261,794, for example, describes a process for the recovery of heavy crude oil from tar sand which comprises treating said tar sand with an emulsion of a solvent in water characterized in that the emulsion contains from 0.5% to 15% by volume of solvent. Solvents which can be used for the purpose comprise hydrocarbons such as, for example, hexane, heptane, decane, dodecane, cyclohexane, toluene, and halogenated hydrocarbons such as, for example, carbon tetrachloride, dichloromethane.

U.S. Pat. No. 4,424,112 describes a process and apparatus for the extraction with solvent of tar oils from oil sands and their separation into synthetic crude oil and synthetic fuel oil which comprises mixing the oil sands with hot water to form a slurry together with the solvent (e.g., toluene), subjecting said slurry to separation so as to obtain a phase comprising solvent and dissolved tar oils and a phase comprising solid material deriving from said oil sands, separating the tar oils from the solvent, putting the tar oils thus obtained in contact with an extraction agent (e.g., methyl butyl ketone) in order to separate the tar oils into synthetic crude oil and synthetic fuel oil, recovering and re-using the solvent, water and extraction agent in the process.

U.S. Pat. No. 4,498,971 describes a process for the separate recovery of oils on the one hand and of asphaltenes and polar compounds on the other, from oil sands which comprises cooling the oil sands to a temperature ranging from −10° C. to −180° C. at which said sands behave like a solid material, grinding said solid material at said temperature to obtain relatively gross particles containing most of the sand and oil and relatively fine particles containing most of the asphaltenes and polar compounds, and mechanically separating the relatively gross particles from the relatively fine particles at said temperatures. The relatively gross particles are subjected to extraction with a solvent (e.g., pentane, hexane, butane, propane) at a temperature ranging from about −30° C. to about −70° C., in order to recover the oil. Such relatively fine particles are subject to extraction with a solvent (e.g., pentane, hexane, butane, propane) at a temperature ranging from about −30° C. to about −70° C., in order to recover the asphaltenes and the polar compounds.

U.S. Pat. No. 4,722,782 describes a process for the recovery of tar from oil sand which comprises putting the oil sand in contact with about 0.4 pounds to about 4 pounds of a hydrocarbon solvent (e.g., paraffins having from 4 to 9 carbon atoms, for example n-heptane) in order to form a slurry including solvent rich in tar and sand free of tar; adding over 0.5 pounds of water per pound of oil sand to the slurry, at a temperature ranging from about 100° F. to about 5° F. below the boiling point of the azeotropic mixture formed by the water and solvent, so as to form a mixture comprising solvent rich in tar, sand free of tar and water; introducing the mixture into a separator container; separating the solvent rich in tar from the mixture thus leaving water and a slurry comprising sand free of tar and residual quantities of solvent; stripping the residual solvent from the sand free of tar, and separating the tar from the solvent rich in tar.

U.S. Pat. No. 8,920,637 Massetti et al. discloses a process for recovering of oils from a solid matrix that comprises subjecting the solid matrix to extraction by mixing with at least one organic solvent having a boiling point lower than or equal to 160° C., operating at a temperature ranging from 5° C. to 40° C. and at atmospheric pressure (1 atm), obtaining a solid-liquid mixture, subjecting said solid-liquid mixture to separation, Obtaining a liquid phase comprising the oils and the organic solvent and a solid phase comprising said solid matrix, and recovering said organic solvent from said liquid phase.

U.S. Pat. No. 4,441,984 to Guerre discloses a process for recovery of oil from oil-bearing limestone by separating the rock into a low-density fraction (which bears a high concentration of oil) and a high-density fraction (which bears a low concentration of oil), contacting only the low-density fraction with an organic solvent in an extraction zone thereby extracting the oil from the low-density fraction, and recovering the extracted oil from the organic solvent.

U.S. Pat. No. 4,110,194 to Peterson et al. discloses a process for and apparatus for extracting bituminous oil from tar sands wherein puts tar sands are put into finely divided form, preferably by pressing them into sheets and flaking the sheets. The flakes are mixed with a solvent for the contained oils for a time sufficient to extract the oils. The resulting slurry is introduced beneath the surface of a body of water and the solids are allowed to settle, while the solvent containing the oil rises to the top to form a liquid phase above the surface of the body of water. The wet solids and the oil-containing solvent are separately removed. After the oil is recovered from the solvent, as by fractional distillation, the solvent is recycled in the process, which is preferably carried on as a continuous operation.

The processes described above, however, also have various drawbacks such as, for example: the use of water which, also in this case, as only a small part of it is recycled, must be treated before disposal; a high energy consumption (e.g., heat); the high content of fine particles having a particle size lower than or equal to 65 micron present in the oils extracted which therefore require further purification treatments before being subjected to upgrading.

The above prior art methods do not provide low cost and environmentally benign approaches to oil recovery from diatomite/clay formations. Furthermore, any process using high pressure high temperature solvents injected underground is potentially hazardous to operate and leaves a high risk of water contamination and long term exposure of work crews in those fields to solvent vapors.

Thus, a better method is needed for oil recovery that is environmentally responsible and relatively low in capital and operating expense. Environmental impact needs to be addressed including how to replace the missing solids and liquids to leave behind a safe, stable underground structure with only minor impact to surface land.

SUMMARY OF THE INVENTION

In an exemplary embodiment the present invention is an above ground process for extracting crude oil from diatomaceous/clay soil comprising the following steps: A process for extracting crude oil above ground from a solid, oil bearing material, comprising the following steps: (a) obtaining a solid, oil-laden material and adding water to it to form a water slurry; (b) processing the oil-laden material above ground by passing it over a shaker screen to separate the oil-laden material into a liquid faction and a shaker separated solid faction, the liquid faction having oil, water and some small sized solids, and the shaker separated solid faction having larger sized chunks of solids; (c) collecting the shaker separated solid faction and processing any overly large sized solid chunks therein into a smaller sized chunks of solids; (d) passing the liquid faction thorough a centrifuge to collect an centrifuged oil faction, a water faction, which water is available for reuse in the process, and a centrifuged solids faction; (d) taking the centrifuged solids faction and the shaker separated solid faction and further processing same in a solids processing plant; (d) in the solids processing plant processing the shaker separated solid fraction by dry grinding, and/or angering, and/or wet grinding with water and solvents to form ground solids; (e) in the solids processing plant directing the centrifuged solids faction and the ground solids into a slurry tank/heated reactor, and adding water and solvent to form a slurry mixture, and heating the slurry mixture for a time period to further disassociate oil from the solid faction in the slurry mixture; (f) taking the heated slurry mixture from the slurry tank/heated reactor and passing it though a centrifuge to yield an oil/solvent faction, a water faction, and a lowered oil content solids faction; and (g) taking the lowered oil content solids faction and subjecting same to thermal desorption and collecting solvent and water therefrom, and thermally desorbed solids.

In another exemplary embodiment, the invention provides a system for the above ground extraction of crude oil from a solid, oil bearing material that has been mined from a subterranean site and brought above ground, the system comprising: a shaker for separating the oil bearing material into a liquid faction which contains liquid and smaller sized chunks of oil bearing material sized smaller than about 0.125" in diameter, and a solid faction containing mid-sized chunks of the oil bearing material ranging in size from 0.125" to about 2" in diameter; a hammer mill for reducing larger-sized chunks that are larger than about 2" in diameter from the shaker to mid-sized chunks and smaller-sized chunks, which mid-sized chunks and smaller-sized chunks are returned to the shaker; a centrifuge for separating the liquid faction into an oil faction which will be collected in an oil tank, a water faction which will be collected for reuse in the system, and a centrifuged solids faction; a solids processing plant comprising a slurry tank/heated reactor, grinding and milling equipment, and a solids process plant centrifuge, wherein the centrifuged solids faction will be added to the slurry tank/heated reactor with solvents and optionally water, and the solids faction from the shaker will be ground and milled by the grinding and milling equipment with solvents and water and also added to the slurry tank/heated reactor to form a slurry mixture, and wherein the solids process plant centrifuge will process the slurry mixture into an oil/solvent faction, a water faction which is available for reuse, and a low oil content solid faction; equipment for removing solvent from the oil/solvent faction to yield crude oil; and thermal desorption equipment for removing solvent and water from the low oil content solid faction, which solvent and water can be reused in the system, forming a virtually solvent-free low oil content solid which can be used for backfill purposes.

In yet another exemplary embodiment, the invention provides a process for extracting crude oil from diatomaceous/clay soil comprising the following steps: (a) Obtaining diatomaceous/clay soils solids and add water to form a mud; (b) adjusting the water content of the mud to a desired ratio of water and solids to form a mixture; (c) either using clays present in the diatomaceous/clay soil solids as the dispersion agent or add additional surfactants and at same time and adjust the mixture to a pH of between about 12 and 14; (d) heating the mixture while mixing to a minimum of 73° C. but below about 95° C. to avoid boiling; (e) subjecting the heated mixture to high shear blending which will reduce the size of the solids and simultaneously form the emulsion; (f) recirculating the mixture through a high shear mill to extract the crude oil from the solid material and to enter the water phase, at which point, the mixture will be in two phases, namely a stable oil in water emulsion phases, and a solid phase substantially free of crude oil; (g) separating the solids from the stable oil in water emulsion; and (h) recovering the crude oil from the stable oil in water emulsion. The above process procedure is also used with the addition of specific surfactants that act as detergents. In this case, the pH is adjusted to between 2 and 5, or 7 to 9. The detergent aids in removing the crude oil from the diatomaceous/clay soils, while the surfactant will be a nonylphenol with 5 or 6 moles of ethylene oxide. The goal is to emulsify only crude in water, allowing all solids to fall out of solution.

These and other features of the invention are described below.

DETAILED DESCRIPTION

The inventors have invented environmentally benign processes and systems for the above ground recovering of crude oils from a deposit initially located in subterranean formation. The processes involve the recovery of crude from oil rich materials, such as diatomite formations that bear high percentages of oil. These diatomite formations are sometimes above ground and therefore such formations can be easily mined with known methods. More commonly, however, they are found below ground. When mined above ground, the diatomite can be ground up and mixed with water to form "muds" that are subsequently processed using the process of the invention. Likewise, underground formations can be readily mined, for example, by using water jet technology. Water jets can cut into formations as large as 30' in diameter and typically at depths from 100 to 2000' below the surface. The resulting diatomite mud is pumped to the surface for oil extraction. Typically, the maximum size of mud rock is 3 inches to still enable it to be pumped to the surface. Pressure and abrasion reduce particle size. Further sieving, crushing or blending may be necessary to achieve uniform muds. In addition to oil rich diatomite formations, there are other oil rich formations that can be accessed for their oil, including shale, sandstone, and limestone formations.

The Applicant has found that using the processes and systems of the invention, the recovery of oil from oil bearing material can be advantageously carried out above ground to thereby avoid introducing any deleterious chemicals back into the earth.

Turning first to a solvent based process, the basic steps for crude recovery after the solid matrix is brought to surface as a mud is as follows, and is described with reference to FIGS. 1A, 1B, and 1C.

Figure 1A:
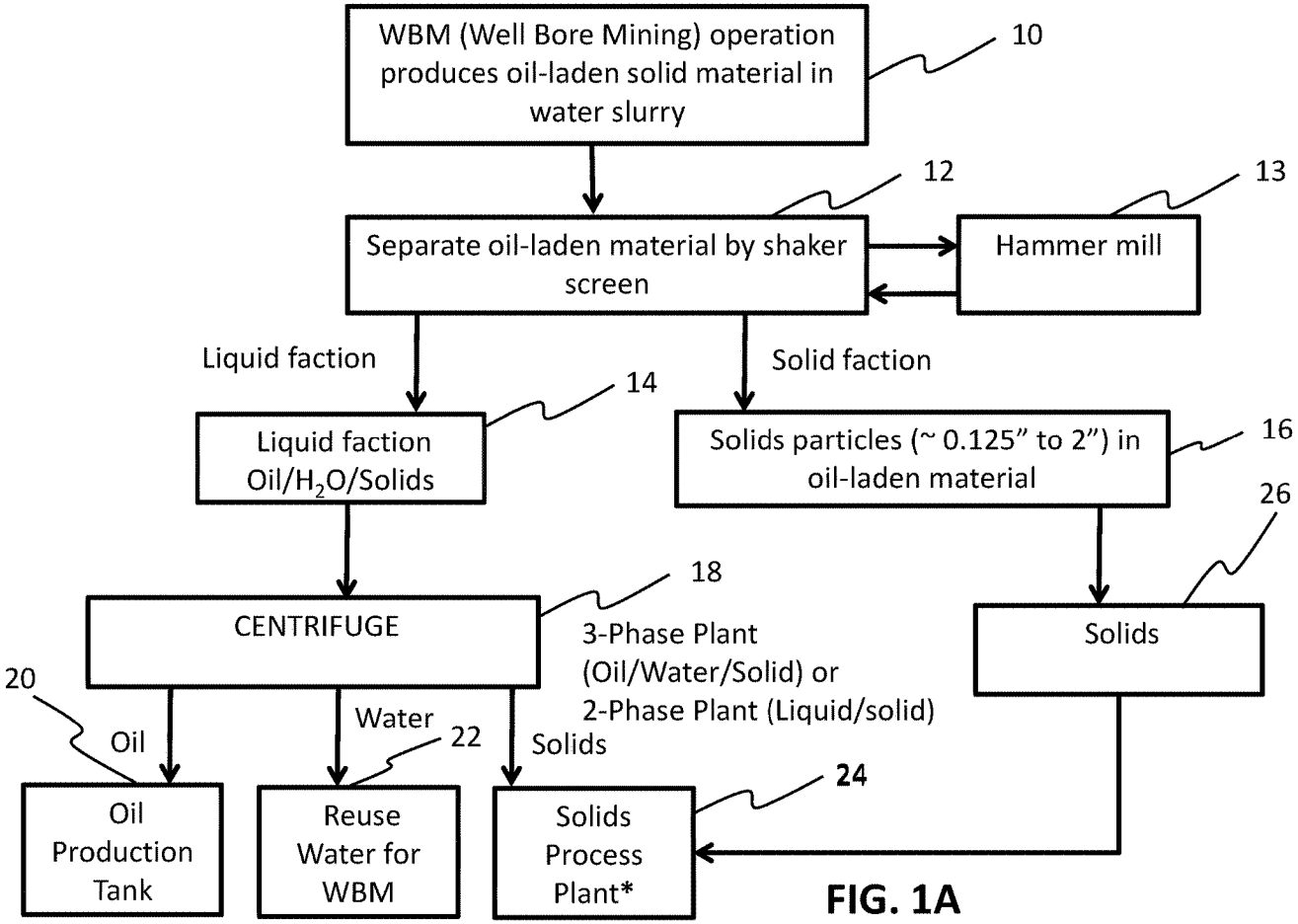
FIGS. 1A-1C are diagrammatic flow charts showing the various steps and equipment used in an exemplary embodiment of the invention using solvents in the oil extraction.

Turning first to FIG. 1A, the well bore mining (WBM) operation 10 produces oil-laden solids in a water slurry, with the water slurry containing some free crude oil. The water content of the mud will generally be in a range of about 1:1 to 4:1 water: solids, and as adjusted as required. The mud is blended at the surface to generate a smooth and uniform slurry. The viscosity of this mud is a function of how much water is used to cut into the formation and how much fresh water is used versus recycled water. By recycling some of the muds, the total water content can be precisely controlled. The higher the recycle the higher the solids content of the mud. The ratio of water to solids is important in extracting crude. If there is too little water the solids cannot be distributed in solution and there is not enough solvent (water as solvent) to start to extract crude. If there is too much water the solution becomes unnecessarily dilute and the volume of water needing to be process becomes unnecessarily high. The ratio of 1:1 water:solids is the minimum, and 4:1 water:solids is the maximum. After about 4:1 water:solids, too much water is being handled.

Next, the oil-laden material is separated by a shaker 12 equipped with ideally at least two shaker screens. This divides the materials into a liquid faction 14 and a solid faction 16. The liquid faction 14 is the faction that passes through a lower shaker screen with a smaller mesh size. The liquid faction 14 will contain water and free crude oil plus any solids that pass through the smaller openings in the screen with the smaller mesh size of the shaker unit. In one embodiment of the invention, the screen with the smaller mesh size of the shaker unit has openings about 3 mm (0.125") in size which allow passage therethrough of particles having a diameter smaller than 3 mm (0.125"). The solid faction 16 will consist of solid particles between about 3 mm to 51 mm (0.125" to 2") in size. Particles larger than 51 cm (2") will be separated out, e.g., by being captured above an upper shaker screen with 51 cm (2") openings which upper screen is located above the shaker screen with the smaller mesh size. Those particles sized between 3 mm (0.125") and 51 mm (2") will pass through the upper shaker screen but not through the lower screen with a smaller mesh size and will be further processed in a solids process plant 24, which is further described in FIG. 1B. Particles that are above 51 mm (2") in diameter will not pass through the upper screen and will be diverted to a crusher or hammer mill 13 where the particles will be reduced in size below 2", and then passed through the shaker unit 12 again for separation as described above, ideally with all particles passing through the upper screen and some particles also passing through the lower screen. Once the liquid faction is obtained, it is subjected to centrifugation 18, e.g., preferentially by a 3-phase plant to separate the liquid faction into and oil faction, water, and solids. Optionally, the liquid faction can be subjected to centrifugation by a 2-phase plant (not shown) to separate the liquid faction into liquids and solids, with the liquids being further processed later. In the case of processing by a 3-phase plant, there will be three outputs from the centrifuge 18, namely oil, which can be collection in a crude oil production tank 20, water which can be collected and reused for well bore mining (WBM) 22, and solids that will be processed in a solids process plant 24. The solids will in most cases still retain some oil and will be directed to a solids processing plant 24. The solids 26 from the solid faction coming off of the shaker 12. (e.g., solid particles sized between about 3 mm to 51 mm (0.125" to 2") in size) will likewise be collected for further processing at the solids processing plant 24.

Figure 1B:
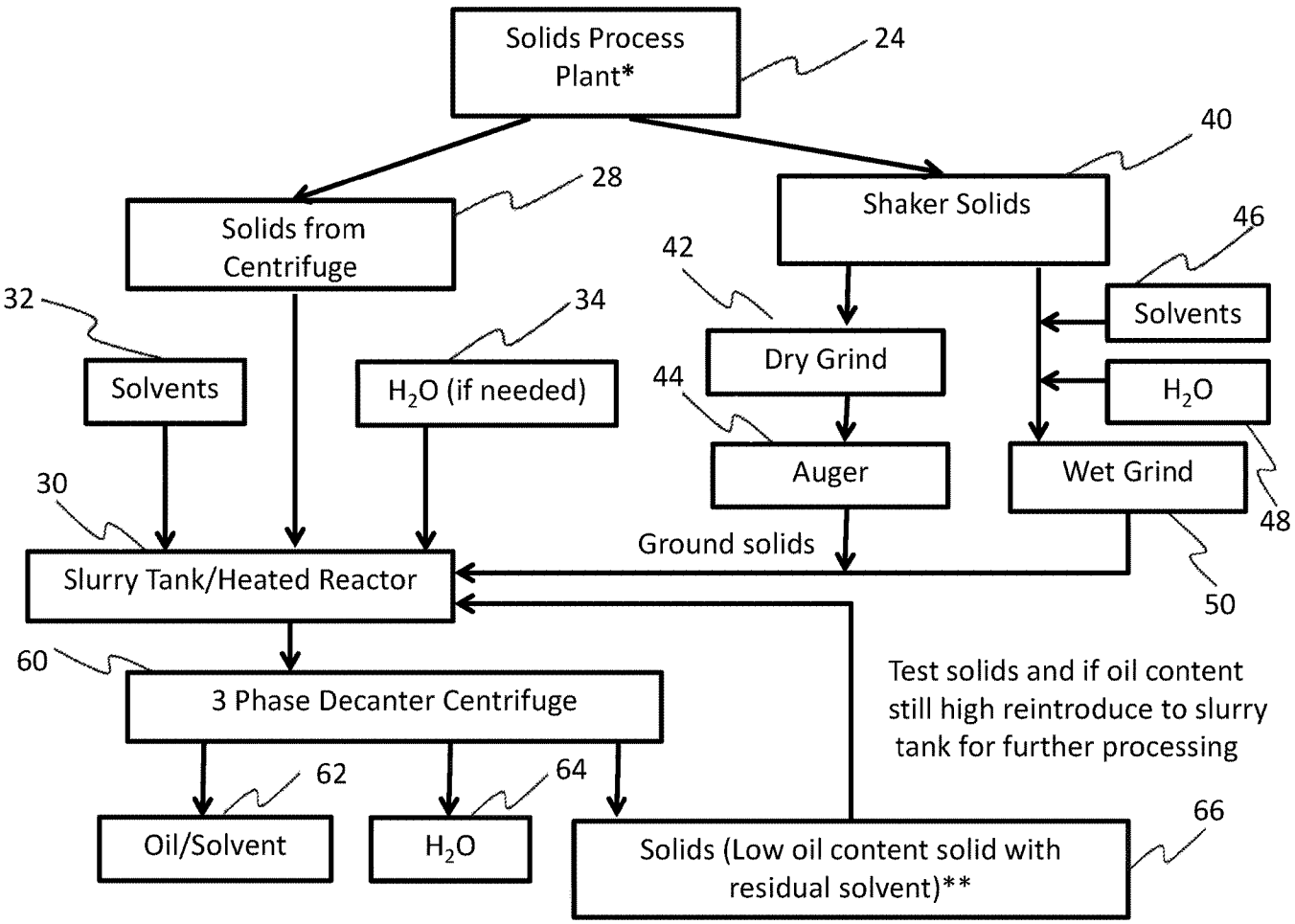

The solids processing plant 24 is now described, in reference to FIG. 1B. The solids processing plant 24 can be incorporated together with the first part of the system of FIG. 1A, or can be located at a different site and can be a completely different system. In the solids processing plant 24, solids from a centrifuge 28 are directed to a slurry tank/heated reactor 30, where one or more non-water solvents 32 and water 34 (if necessary) are added to the slurry tank/heated reactor 30. Hereinafter use of the term "solvent" refers to non-water solvents. The contents of the slurry tank/heated reactor 30 can preferably be heated to about 120° F. to about 200° F. for about 1 to 4 hours. If desired, a blanket of inert gas, such as nitrogen, can be introduced into the top of the slurry tank/heated reactor 30 for enhanced safety. In the process, the solvents can be one or more solvents selected from the group consisting of light naphtha, naphtha, heavy naphtha, aromatics including benzene, trichlorobenzene, 1,2,3 trichlorobenzene, cumene, biodiesel methyl ester, alcohols (methanol, butanol, ethanol, isopropanol), wide cut aromatics, toluene and turpentine or di limonene compounds. The solvents can be selected based on the nature of the oil captured in the formation, e.g., light oil versus heavy oil may require different solvents. Some preferred solvents include light naphtha and alcohols such as methanol and ethanol, with methanol being particularly useful since it is zeotropic and can be easily removed from water by distillation. Acetone is also an attractive optional solvent because it is zeotropic. The inventors have found that adding between about 0.5% to about 70% weight percent of methanol to the water will greatly aid in the oil extraction process of the invention as methanol will help mobilize the crude oil from the diatomaceous earth. Moreover, recover of the methanol can be easily and reliably accomplished during the phase of driving the water off, including by distillation.

Solids from a shaker 40 are further processed with larger particles being subjected to dry grinding 42 and augering 44, and with solvents 46 and water 48 added to form a wet grind 50. The thusly processed shaker solids are directed to the slurry tank/heated reactor 30. The contents of the slurry tank/heated reactor 30 are preferably subjected to 3 phase decanter centrifugation 60, with the outputs being an oil/solvent mixture 62, water 64, and solids having a lower oil content with some residual solvent 66. The oil/solvent 62 can be further processed to remove the solvent from the oil, e.g., but filtration and/or thermal desorption, with the now pure oil be collected, and the solvent be made available for reuse. The water 64 will be likewise made available for reuse in well bore mining or otherwise. As for the solids having a lower oil content with some residual solvent 66, these solids will be tested to determine their oil contents and solvent content. If the oil content and residual solvent content are sufficiently low and pass all regulatory requirement without further processing, the solids may be used, e.g., to be reintroduced into the well bore mining site to reclaim the mining site to its previously unmined condition, or an even better condition.

Figure 1C:
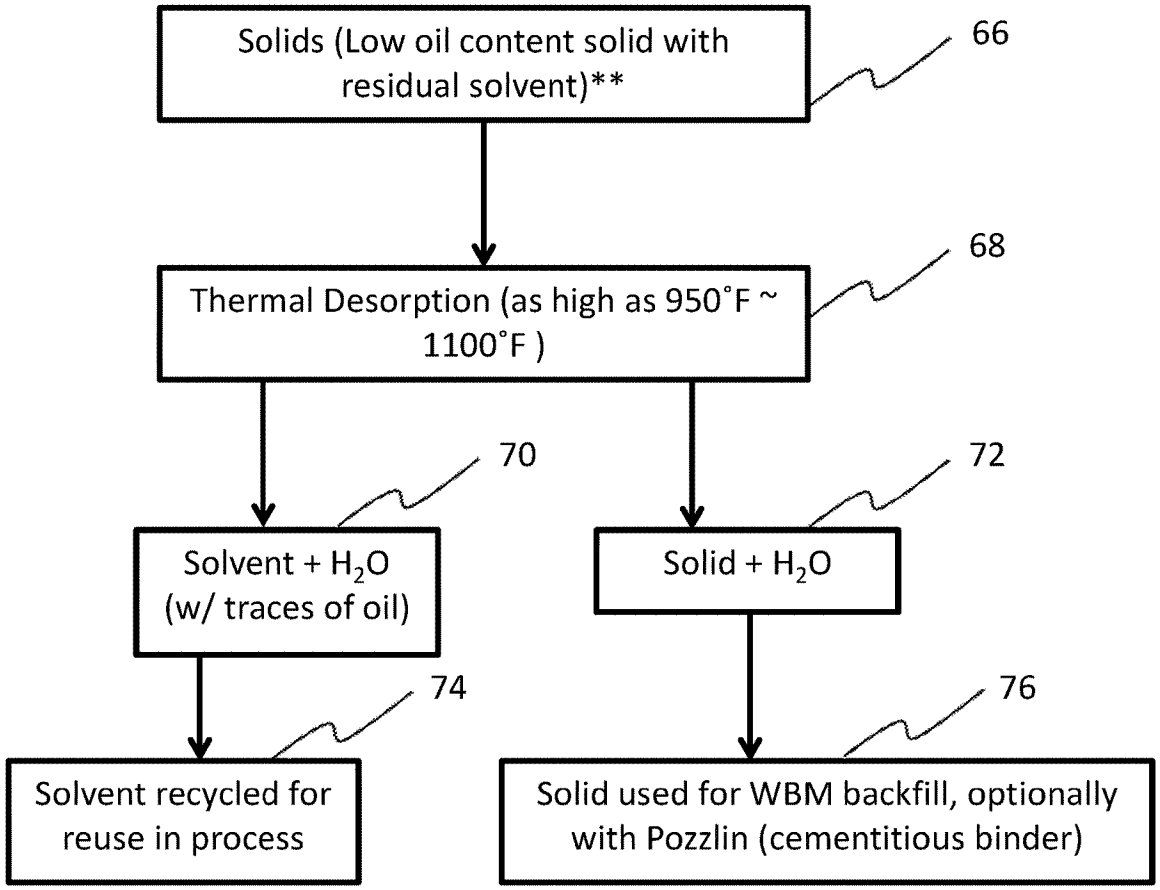

Turning lastly to FIG. 1C, this shows processing of the solids produced by the solids processing plant with the solids having a lower oil content with some residual solvent 66. Thermal desorption equipment 68 can be used to remove solvent and water from the low oil content solid faction, which solvent and water can be reused in the system, forming a virtually solvent-free low oil content solid which can be used for backfill purposes. The solids are subjected to thermal desorption, preferably at about (e.g., at about 250° F. to 450° F. (about 121° C. to 232° C.) to as high as about 950° F. to 1100° F. (about 510° C. to 595° C.). This drives off solvent+water (possibly with some small traces of oil) 70 and solids with some residual water 72. The solvent plus water 70 is processed to collect the solvent which will be recycled for reuse. In the process of the invention, some preferred solvents include light naphtha and alcohols such as methanol and ethanol, with methanol being particularly useful since it is zeotropic and can be easily removed from water by distillation. The now clean solids, free of any solvents or brought down to a very low level of solvent, can be used, for example by being reintroduced into the well bore mining site to reclaim the mining site to its previously unmined condition or even better.

Figure 2:
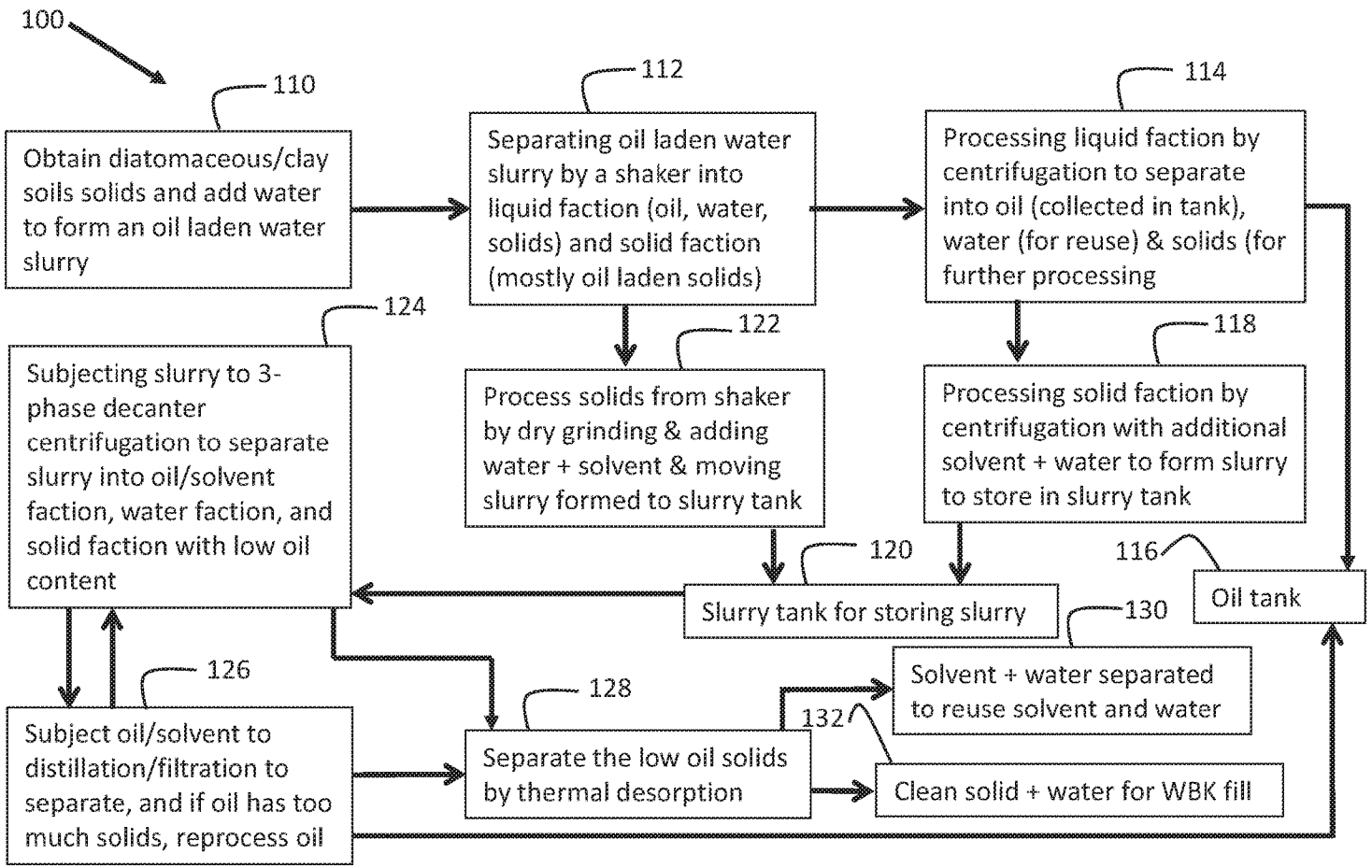
FIG. 2. is a diagrammatic flow chart showing the various steps of an embodiment of the invention using solvent in the oil extraction.

In another embodiment the present invention is an above ground process for extracting crude oil from diatomaceous/clay soil 100 comprising the following steps, and is described with reference to FIG. 2: (a) Obtaining diatomaceous/clay soils 110, or other materials high in oil and adding water to form an oil laden solids/water slurry, for example by well bore mining using high pressure water; (b) Separating the oil laden water slurry by a shaker into a liquid faction (having oil, water, and solids) and a solid faction having mostly oil laden solids 112; (c) Processing the liquid faction by centrifugation to separate it into oil, water, and solid factions 114, wherein the oil faction will be collected, for example in a tank 116, the water will be collected and made available for reuse, and the solids will be collected for further processing to remove any remaining oil; (d) Processing the solid factions from the centrifuge by adding additional solvent and water is necessary to form a slurry 118, which slurry will be stored in a slurry tank 120; (e) Processing the solids from the shaker by dry grinding the solids and adding water and solvents 122 and moving the newly formed slurry to the slurry tank 120; (f) Subjecting the slurry from the slurry tank to three phase decanter centrifugation to separate the slurry into an oil/solvent faction, a water faction, and a solid faction with a low level of solvent/oil content 124; (g) Subjecting the oil/solvent faction to distillation or filtration to remove the solvent from the oil for reuse, and test the solids for oil content and if oil content is still high, reintroduce the solids to the slurry tank 126 in step (f) for further processing. Once the processed solids have a low enough oil content with residual solvent, in step (h) the solids will be further processed by thermal desorption 128 (e.g., at about 250° F. to 450° F. (about 121° C. to 232° C.) to as high as about 950° F. to 1100° F. (about 510° C. to 595° C.) to separate out solvent+water and solids+water 130. The solvent will be extracted from the water so that the water and solvent can be reused, and the now clean solids+water can be used for WBM backfill 132, optionally with additives such as solidifying agents such as Pozzlin (a silica cement additive) or other cementitious binders.

The process of the invention allows a good recovery yield of the oils to be obtained, i.e., an oil recovery yield higher than or equal to 90%, such yield being calculated with respect to the total quantity of the oils present in the solid matrix by weight. The process of the invention allows this good recovery yield to he obtained all while operating with a lower energy requirement than prior art systems. Furthermore, the process of the invention results in a final solid residue to be obtained, i.e., a crude deficient solid matrix, with characteristics that allow it to he replaced in situ without the necessity for further treatments. If a petroleum solvent is added during the processing in a sufficiently large enough quantity, it may be necessary to recover the solvent from the solids before placing the solids back in the ground. This solvent recovery can he for economic reason (e.g., to allow collection and reuse of the solvent), for regulatory reasons, and/or for safety reasons.

The process and system of the invention achieves high rates of crude oil removal using relatively less water, less energy, and more environmentally benignly than using prior art methods. Moreover, the resulting solids will have relatively low levels of remaining petroleum products or added chemicals, and can be reused (e.g., when mixed with Portland cement or Pozzlin, a cementitious binder) to refill the extraction site to restore the site to lessen the chance for ground subsiding from occurring.

The above solvent-based system and process relies on the use of solvents to help extract the oil for the solids and liquid factions. Applicant has also found that the recovery of crude oils from a diatomaceous formation be also be carried out by creating an oil-in-water emulsion, wherein the formations of the oil in water emulsion is a key aspect of the method by which the extraction of the crude from the solids is accomplished. The emulsion process extracts the crude from the solids as the crude preferentially enters the water phase. This emulsion can be formed by utilizing the clays contained in the solids as dispersion agents and adjusting the pH accordingly to form the emulsion, or by adding surfactants as needed to form the emulsion. While forming the emulsion, additional detergents can be added or small amounts of solvents to aid in the crude extraction process.

Process and System of Oil Recover using Emulsion Formation. There are several ways in which emulsions of these types are formed. Emulsions can be formed that are stabilized by dispersed solid particles and in our case, with clay as the stabilizing dispersed solid particle.

Emulsions stabilized by solid particles are known as "Pickering emulsions". A Pickering emulsion is an emulsion that is stabilized by solid particles (for example colloidal silica) which adsorb onto the interface between the two phases. This type of emulsion was named after S.U. Pickering, who described the phenomenon in 1907, although the effect was first recognized by Walter Ramsden in 1903.

If oil and water are mixed and small oil droplets are formed and dispersed throughout the water, eventually the droplets will coalesce to decrease the amount of energy in the system. However, if solid particles are added to the mixture, they will bind to the surface of the interface and prevent the droplets from coalescing, thus causing the emulsion to be more stable.

Properties such as hydrophobicity, shape, and size of the particle can have an effect on the stability of the emulsion. The particle's contact angle to the surface of the droplet is a characteristic of the hydrophobicity. If the contact angle of the particle to the interface is low, the particle will be mostly wetted by the droplet and therefore will not be likely to prevent coalescence of the droplets. Particles that are partially hydrophobic (i.e., contact angle of approximately 90°) are better stabilizers because they are partially wettable by both liquids and therefore bind better to the surface of the droplets.

When the contact angle is approximately 90°, the energy required to stabilize the system is at its minimum. Generally, the phase that preferentially wets the particle will be the continuous phase in the emulsion system.

Additionally, it has been demonstrated that the stability of the Pickering emulsions can be improved by the use of amphiphilic "Janus particles", due to the higher adsorption energy of the particles at the liquid-liquid interface. In the case of the instant invention, surfactants such as amines, amphoteric or other can optionally be added to improve the interface.

Other adjustments will be made to change the clay's behavior. Clays can be water loving or oil loving. In oil sands froth treatment, an undesirable intermediate layer often accumulates during the separation of water-oil emulsions. The layer referred to as rag layer is a complex mixture of water, oil, solids and interfacially active components. The presence of a rag layer has a detrimental impact on the separation of water and fine solids from diluted bitumen. In the Applicant's system, Applicant has noted a tendency toward oil loving, which is noted by layer below crude floating on the surface of the water as the emulsion is broken. Some of this behavior is caused by components in the crude, mainly naphthenic acids. These acids can make the clay more oil loving. The clay's charge on the surface is most likely positive, which is attracted to the negative charge of carboxylate (naphthenate). This can be changed by adjusting the pH, adding a particular solvent that is non polar in small amounts or by adding certain surfactants. All of these additions can adjust the clay's behavior and the emulsion stability and the emulsions ability to extract crude from the soil particle.

As noted, the process involves the recovery of crude from starting oil bearing material such as a diatomite formation. These diatomite formations can be above ground and therefore easily mined with known methods, or more commonly are found underground as is described above to form muds that are subsequently processed using the processes of the invention.

The basic steps for crude recovery using emulsion formation after the solid matrix is brought to surface as a mud is as follows: 1) Adjust the water content of the mud as required (1:1 to 4:1 water: solids). The mud is blended at the surface to generate a smooth and uniform slurry. The viscosity of this mud is a function of how much water is used to cut into the rock and how much fresh water is used versus recycled water. By recycling some of the muds, the total water content can be precisely controlled. The higher the recycle the higher the solids content of the mud. The ratio, water to solids is important to both forming the emulsion and extracting crude. Too little water, and an emulsion will not form, as solids cannot be distributes in solution. Too little water and then there is not enough solvent (water as solvent) to extract crude and provide the continuous phase for the crude to emulsify into. The ratio of 1:1 is the minimum, and 4:1 is the maximum. After 4:1, too much water is being handled. 2) Either use the clays present in the solids as the dispersion agent or add additional surfactants and at same time and adjust the mixture to a pH of between about 12 and 14. Sodium hydroxide, for example, can be effectively used to change the pH. The above process procedure is also used with the addition of specific surfactants that act as detergents. In this case, the pH is adjusted to between 2 and 5, or 7 to 9. The detergent aids in removing the crude oil from the diatomaceous/clay soils, while the surfactant will be a nonylphenol with 5 or 6 moles of ethylene oxide. The goal is to emulsify only crude in water, allowing all solids to fall out of solution. Additional surfactants if needed are determined during the laboratory phase prior to the project starting. While forming the emulsion, additional detergents or small amounts of solvents can be added to aid in the crude extraction process. These too will be determined during laboratory phase prior to project start. Additives range from 0.5% to 2.0% by weight of the water phase. The detergents can be a surfactant or a particular solvent. Good optional solvents include ethanol and particularly methanol (which is zeotrophic, meaning that the water and methanol can be efficiently separated from each other by distillation). The optional solvent can be added until the solvent comprises about 0.5% to about 70% weight percent of the liquid. (3) If no optional solvent is added, heat the mixture while mixing to a minimum of 73° C. but below about 95° C. to avoid boiling. If an optional solvent has been added, heat the mixture while mixing to an elevated temperature that is below the boiling temperature of the optional solvent. For example, methanol has a boiling point=64.7° C.) and ethanol has a boiling point 78.24° C., so if methanol is the added solvent, heat the mixture to below about 60° C. and if ethanol is added heat the mixture to below about 73° C. (4) Subject the heated mixture to high shear blending which will reduce the size of the solids and simultaneously form the emulsion. The high shear mill blending will reduce the diatomaceous silica size to less than 5 mm. During this stage, extraction of crude is accomplished by the effects of the pH, temperature and energy from shearing. The emulsion is then formed from the conditions of the shear, pH temperature and clay content and clay type. (5) Recirculate the mixture through the high shear mill for approximately 30 minutes to extract the crude oil from the solid material and to enter the water phase. At this point, the mixture should be two phases, stable oil in water emulsion and solids substantially free of crude oil. (6) Separate the solids from the stable oil in water emulsion. These solids will gravity separate or more efficiently, can be removed by subjecting the two phases to centrifugation (such as a decanter), or gravity settling. A decanter centrifuge is a centrifuge with the bowl and scroll in a horizontal configuration as opposed to a vertical disk stack. The machine is specifically designed to separate liquids and solids in industrial settings at high volumes. (7) Recover the crude oil. The emulsion, now minus the solids, is subjected to thermal desorption or an emulsion breaker (chemical to destabilize the emulsion) to remove most of the water (which is recovered for reuse) and break the emulsion, thereby yielding the crude oil which is collected. Thermal desorption involves feeding the crude water mixture into a heated barrel and screw, sometimes under vacuum. The screw moves one phase along, the phase that does not turn to vapor, the vapor phase is removed at the top end of the barrel and cooled back to a liquid in a condenser. The solids removed can be treated as per above several additional times to achieve the crude oil recovery desired. Yield can be determined in the field by use of a field "Retort" test, a small distillation unit that can extract liquids from solids, or in a proper lab using a "Soxhlet Extraction" method, which is a repeated solvent wash extraction of liquids from solids. If an optional solvent was added, utilize distillation to separate the solvent from the water so that the solvent can be reused in the process.

In the above process, the optional solvent (if used) can be selected form chemicals including light naphtha, naphtha, heavy naphtha, aromatics including benzene, trichlorobenzene, 1,2,3 trichlorobenzene, cumene, biodiesel methyl ester, alcohols (methanol (boiling point=64.7° C., 148.5° F.), butanol, ethanol (boiling point 78.24° C., 172.83° F.) isopropanol), wide cut aromatics, toluene and turpentine or di limonene compounds. Some preferred solvents include light naphtha and alcohols such as methanol and ethanol, with methanol being particularly useful since it is zeotropic and can be easily removed from water by distillation. Acetone is also an attractive optional solvent because it is zeotropic. The inventors have found that adding between about 0.5% to about 70% weight percent of methanol to the water phase will greatly aid in the oil extraction process of the invention as methanol will help mobilize the crude oil from the diatomaceous earth. Moreover, recover of the methanol can be easily and reliably accomplished during the phase of driving the water off, including by distillation.

The process of the invention allows a good recovery yield of the oils to be obtained, i.e., an oil recovery yield higher than or equal to 90%, such yield being calculated with respect to the total quantity of the oils present in the solid matrix by weight. The process of the invention allows this good recovery yield to be obtained all while operating with a lower energy requirement than prior art systems. Furthermore, the process of the invention results in a final solid residue to be obtained, i.e., a crude deficient solid matrix, with characteristics that allow it to be replaced in situ without the necessity for further treatments. If a petroleum solvent is added during the processing in a sufficiently large enough quantity, it may be necessary to recover the solvent from the solids before placing the solids back in the ground. This solvent recovery can be for economic reason (e.g., to allow collection and reuse of the solvent), for regulatory reasons, and/or for safety reasons.

The emulsion formation process of the invention achieves high rates of crude oil removal using relatively less water, less energy, and more environmentally benignly than using prior art methods. Moreover, the resulting solids will have relatively low levels of remaining petroleum products or added chemicals, and can be reused (e.g., when mixed with Portland cement) to refill the extraction site to restore the site to lessen the chance for ground subsiding from occurring.

Figure 3:
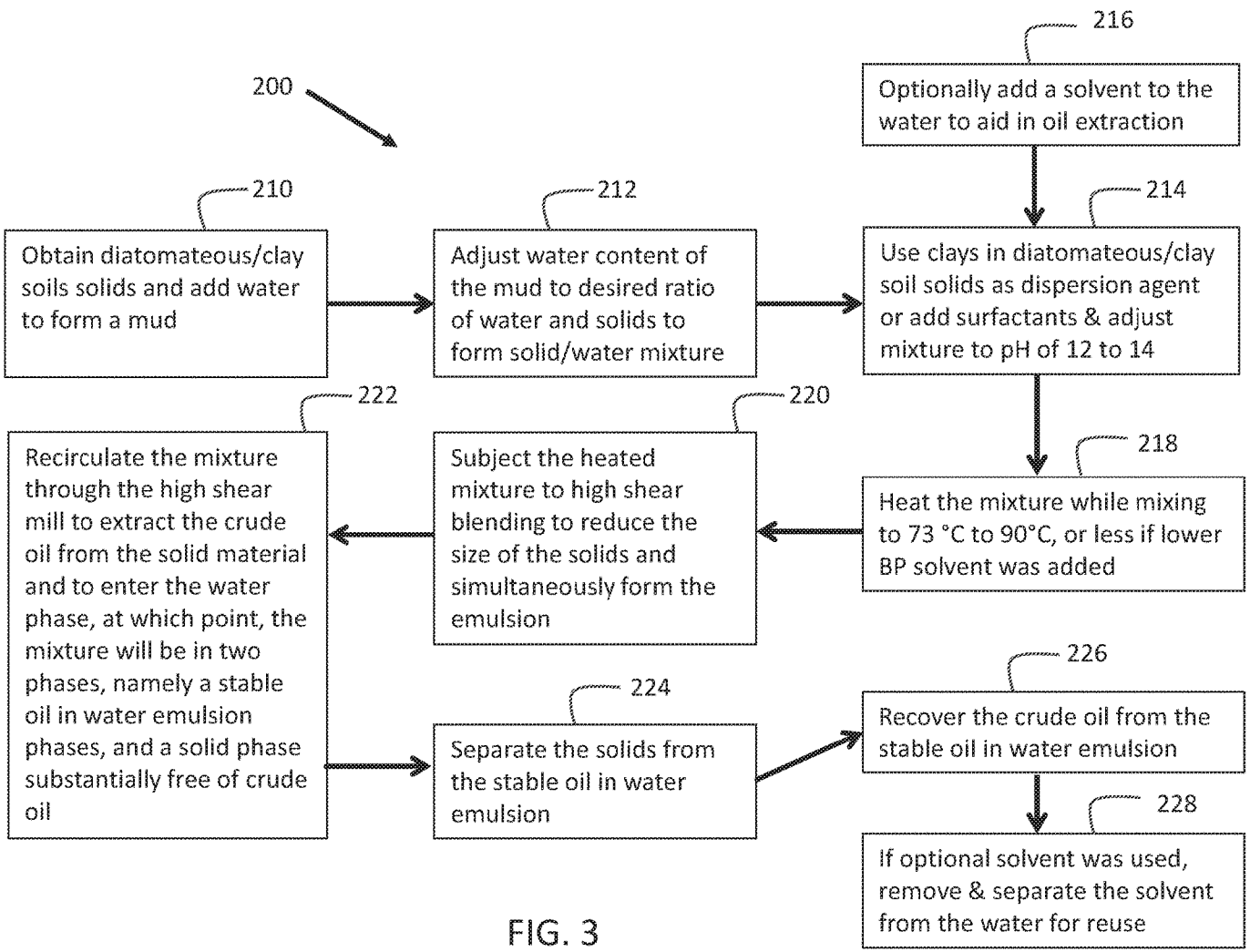
FIG. 3 is a diagrammatic flow chart showing the various steps of an embodiment of the invention using emulsification in the oil extraction.

Turning to FIG. 3 there is shown a diagrammatic flow chart showing the various steps of an emulsion formation process for above ground oil recovery embodiment of the invention 200. In a first step (210 in the figure), first obtain diatomaceous/clay soils solids and add water to form a mud. Next, adjust the water content of the mud to a desired ratio of water and solids to form solid/water mixture (212). Then, use clays in diatomaceous/clay soil solids as a dispersion agent or add surfactants & adjust mixture to pH of 12 to 14 (214). This step can also be modified with the addition of specific surfactants that act as detergents. In this case, the pH is adjusted to between 2 and 5, or 7 to 9. The detergent aids in removing the crude oil from the diatomaceous/clay soils, while the surfactant will be a nonylphenol with 5 or 6 moles of ethylene oxide. The goal is to emulsify only crude in water, allowing all solids to fall out of solution. If an optional solvent will be added, add it at this step (216). After that, heat the mixture while mixing to 73° C. to 95° C. (temperatures at atmospheric pressure), or less if a lower boiling point optional solvent was added (218). Keeping the temperature below 95° C. will help prevent boiling with water only, and for example, under 60° C. if methanol was added. Next, subject the heated mixture to high shear blending to reduce the size of the solids and simultaneously form the emulsion (220). After that, recirculate the mixture through the high shear mill to extract the crude oil from the solid material and to enter the water phase, at which point, the mixture will be in two phases, namely a stable oil in water emulsion phases, and a solid phase substantially free of crude oil (222). Then, separate the solids from the stable oil in water emulsion (224). Following this, recover the crude oil from the stable oil in water emulsion (226). Lastly, if an optional solvent was used, remove and separate the solvent from the water for reuse, such as by distillation (228).

EXAMPLE

In a 1,000 ml beaker, add 500 ml of oil field process water (oil field process water is the recovered water from operations, and new incoming water is also used). Add 5 grams of sodium hydroxide flakes and dissolve to raise the pH to the range of about 12 to 14 pH. Optionally add a solvent such as methanol at about 0.5% to about 70% weight percent of the water. Heat this mixture to about 73° C. and maintain at this temperature. Add 200 grams of passing 5 mesh diatomaceous/clay soil containing 18.2% crude by weight (determined by solvent extraction) to the hot mixture. High shear (Silverson L4R mixer) this mixture to both reduce particle size of soil while extracting crude from soil during shearing. During this extraction phase, the crude oil emulsion is formed using clay as the dispersed stabilizing agent. The mixture will turn very black as crude is extracted and emulsified. After about 30 minutes of shear time, turn off mixer, allow solids to fall to bottom of beaker. The liquid phase is separated in a separate beaker. The emulsion pH is adjusted to neutral (pH 7) and placed in an oven at 65° C. to evaporate the water and the optional methanol, leaving the crude behind. The crude recovery was determined to be 91% of the 18.2% crude available in the diatomaceous/clay soil.

The preferred embodiments of this invention have been disclosed, however, so that one of ordinary skill in the art would recognize that certain modifications would come within the scope of this invention.

What is claimed is:

1. A process for extracting crude oil above ground from a solid, oil bearing material, comprising the following steps:

(a) obtaining a solid, oil-laden material and adding water to the solid, oil-laden material to form a water and oil-laden material slurry;

(b) processing the water and oil-laden material slurry above ground by passing it over a shaker screen to separate the oil-laden material into a liquid faction and a shaker separated solid faction, the liquid faction having oil, water and some small sized solids, and the shaker separated solid faction having larger sized chunks of solids;

(c) collecting the shaker separated solid faction and processing any overly large sized solid chunks therein into smaller sized chunks of solids;

(d) passing the liquid faction thorough a centrifuge to collect a centrifuged oil faction, a water faction, which water faction is available for reuse in the process, and a centrifuged solids faction;

(e) taking the centrifuged solids faction and the shaker separated solid faction and further processing same in a solids processing plant;

(f) in the solids processing plant processing the shaker separated solid fraction by dry grinding, and/or augering, and/or wet grinding with water and a solvent to form ground solids;

(g) in the solids processing plant directing the centrifuged solids faction and the ground solids into a slurry tank/heated reactor, and adding water and a solvent to form a slurry mixture, and heating the slurry mixture for a time period to further disassociate oil from the solids' faction in the slurry mixture;

(h) taking the heated slurry mixture from the slurry tank/heated reactor and passing it though a centrifuge to yield an oil/solvent faction, a water faction, and a lowered oil content solids faction; and (i) taking the lowered oil content solids faction and subjecting same to thermal desorption and collecting solvent and water therefrom to yield thermally desorbed solids.

2. The process for extracting crude oil above ground from a solid, oil bearing material of claim 1, wherein step (a) of obtaining a solid, oil-laden material and adding water to it to form a water and oil-laden material slurry is carried out by well bore mining.

3. The process for extracting crude oil above ground from a solid, oil bearing material of claim 1, wherein the solid, oil bearing material comprises oil bearing diatomaceous earth.

4. The process for extracting crude oil above ground from a solid, oil bearing material of claim 1, wherein step (c) of processing any overly large sized solid chunks into a smaller sized chunks of solids is accomplished using a hammer mill to reduce the solids into solid chunks sized between about 0.125" and 2", after which the smaller sized solid chunks are passed over the shaker screen in step (b).

5. The process for extracting crude oil above ground from a solid, oil bearing material of claim 1, wherein in steps (f) and (g) at least one solvent is used selected from the group consisting of light naphtha, naphtha, heavy naphtha, aromatics consisting of benzene, trichlorobenzene, 1,2,3 trichlorobenzene, and cumene, biodiesel methyl ester, alcohols consisting of methanol, butanol, ethanol, and isopropanol, wide cut aromatics, toluene, and turpentine or di limonene compounds.

6. The process for extracting crude oil above ground from a solid, oil bearing material of claim 1, wherein in step (g) the slurry mixture is heated at about 120° F. to about 200° F. for about 1 hour to 4 hours.

7. The process for extracting crude oil above ground from a solid, oil bearing material of claim 1, wherein in step (f) the centrifuge comprises a three phase decanter centrifuge.

8. The process for extracting crude oil above ground from a solid, oil bearing material of claim 1, wherein in step (h) the solvent collected from thermal desorption of the solid will be reused in the process.

9. The process for extracting crude oil above ground from a solid, oil bearing material of claim 1, wherein in step (i) the thermally desorbed solids can be used for backfill at a site from which the solid, oil bearing material was removed.

* * * * *